United States Patent [19]

Cunnane

[11] Patent Number: 4,581,773

[45] Date of Patent: Apr. 15, 1986

[54] PROTECTIVE HAT

[75] Inventor: Janice D. Cunnane, Worcester, Pa.

[73] Assignee: Plum Enterprises, Inc., Worcester, Pa.

[21] Appl. No.: 576,459

[22] Filed: Feb. 2, 1984

[51] Int. Cl.[4] ..... A42B 1/04

[52] U.S. Cl. ..... 2/204; 2/411

[58] Field of Search ..... 2/204, 205, 202, 200, 2/201, 410, DIG. 7, 114, 411, 412, 413, 414, 415, 416

[56] References Cited

U.S. PATENT DOCUMENTS

| | | | |
|---|---|---|---|
| D. 167,789 | 4/1952 | Adams | 2/205 |
| 1,080,690 | 12/1913 | Hipkiss . | |
| 1,375,845 | 4/1921 | Horan . | |
| 1,508,702 | 9/1924 | Lark | 2/204 |
| 2,136,473 | 11/1938 | Sloan et al. . | |
| 2,296,335 | 9/1942 | Brady . | |
| 2,451,483 | 10/1948 | Goldsmith . | |
| 2,685,091 | 8/1954 | Thill | 2/204 |
| 2,717,384 | 9/1955 | Frothingham | 2/414 |
| 2,983,925 | 5/1961 | Gettinger | 2/204 |
| 3,171,133 | 3/1965 | Steffen | 2/414 |
| 3,276,039 | 10/1966 | Lish | 2/201 |
| 3,295,511 | 1/1967 | Crouzet | 126/208 |
| 3,366,971 | 2/1968 | Scherz | 2/200 |
| 3,440,660 | 4/1969 | Krinke | 2/410 |
| 3,551,911 | 1/1971 | Holden | 2/411 |
| 3,555,561 | 1/1971 | Neis . | |
| 3,725,956 | 4/1973 | Reisen | 2/205 |
| 4,279,097 | 7/1981 | Walker | 2/200 |

FOREIGN PATENT DOCUMENTS

| | | | |
|---|---|---|---|
| 646754 | 11/1928 | France | 2/410 |

*Primary Examiner*—Werner H. Schroeder
*Assistant Examiner*—Mary A. Ellis
*Attorney, Agent, or Firm*—Robert C. Podwil

[57] ABSTRACT

Protective headgear for infants and young children comprises a head-enveloping member having the appearance of a conventional hat, but constructed of a core of impact absorbent foam, encapsulated within a shell of textile fabric material, the textile fabric material providing the inner and outer surfaces of the garment.

8 Claims, 9 Drawing Figures

PROTECTIVE HAT

BACKGROUND OF THE INVENTION

This invention relates to protective hats, and more specifically, to protective hats suitable for use by infants and toddlers, and which have the appearance of conventional infant's and children's headwear.

Numerous kinds of protective headwear have heretofore been proposed.

Such headwear, for example, the protective helmet shown in U.S. Pat. No. 3,171,133, issued Mar. 2, 1965, to Steffen, is often quite unconventional in appearance, and objectionable for that reason.

Attempts have been made to provide combined dress and protective headwear for children. For example, U.S. Pat. No. 2,717,384, issued Sept. 13, 1955 to I. Frothingham, proposed a combined dress and protective hat which included a circular cap, constructed over a cruciform framework of protective elements. This device, too, differs drastically in appearance from conventional headgear, and reveals itself at once to be a specially constructed protective device.

It is, therefore, a principal object of this invention to provide protective headgear which has a conventional and unobjectional appearance, but which economically and reliably provides a protective function. Another objective of this invention is to provide an inexpensive and readily manufactured apparatus which offers the above advantages.

SUMMARY OF THE INVENTION

The foregoing and other objects of this invention are realized, in presently preferred forms of the invention, by providing a protective hat which comprises a head-receiving member which overlies and protects at least the sides, top and rear of the head of a wearer, the head-receiving member comprising a core of resilient shock absorbent polymeric foam material and a shell of textile fabric, so constructed as to have the appearance of a conventional hat.

In one presently contemplated form of the invention, the head-receiving member is fabricated from two subassemblies, one an arcuate member which partly encircles the head of a wearer, and the other a flat member, which may be referred to as a "closure" member, edge portions of which are complemental with and coupled to respective edge portions of the arcuate member. Together, the arcuate member and the closure member form a concavity adapted to receive the head of a wearer.

In the above form of the invention, the arcuate member and the closure member have an inner core, comprising a layer of impact absorbent foam material, preferably of the closed-cell type, fully enclosed within a shell of textile fabric to give the article a conventional appearance and "feel".

In another contemplated form of the invention, the arcuate member covers the top and back of the head, and side members, edge portions of which are complemental with edge portions of the arcuate member, cover the sides of the head.

There are seen in the drawings forms of the invention which are presently preferred (and which represent the best mode contemplated for carrying the invention into effect), but it should be understood that the invention is not limited to the precise arrangements and instrumentalities shown.

DETAILED DESCRIPTION OF THE INVENTION

Figure 1:
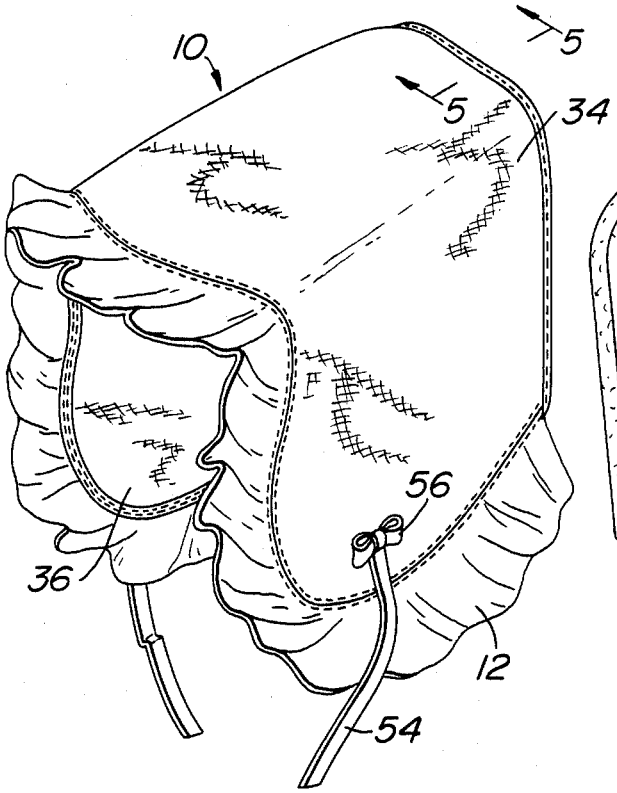
FIG. 1 is a perspective view of a protective hat in accordance with the present invention.

Referring to the drawings in detail, wherein like reference numerals indicate like elements, there is seen in FIG. 1 a protective hat designated generally by the referene numeral 10.

Figure 7:
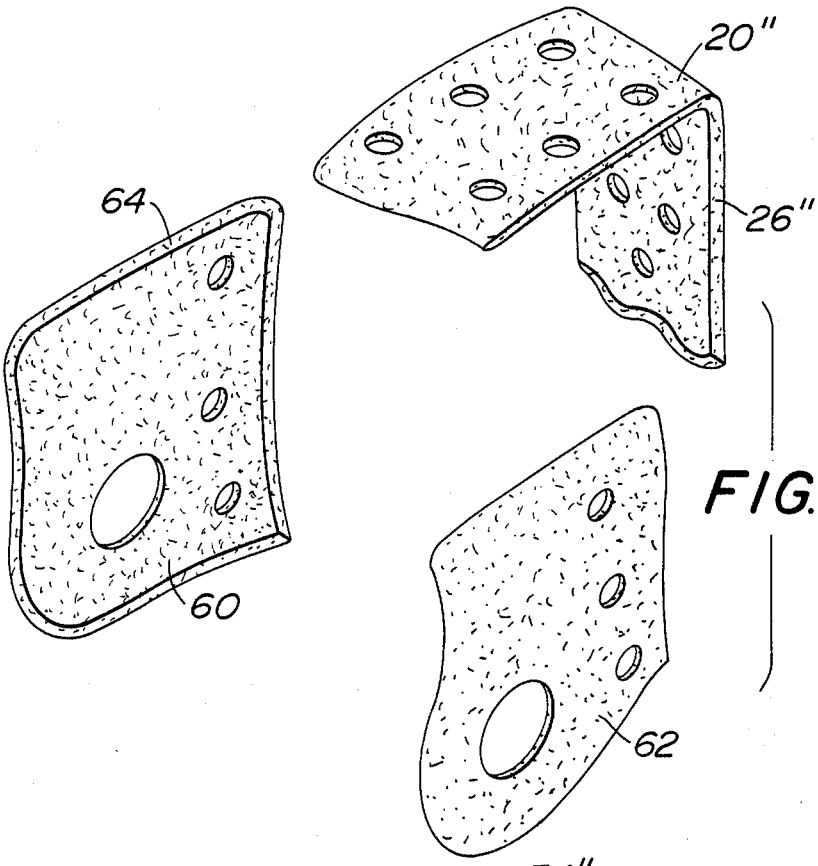
FIG. 7 is an exploded view, showing details of another embodiment of the invention.
Figure 8:
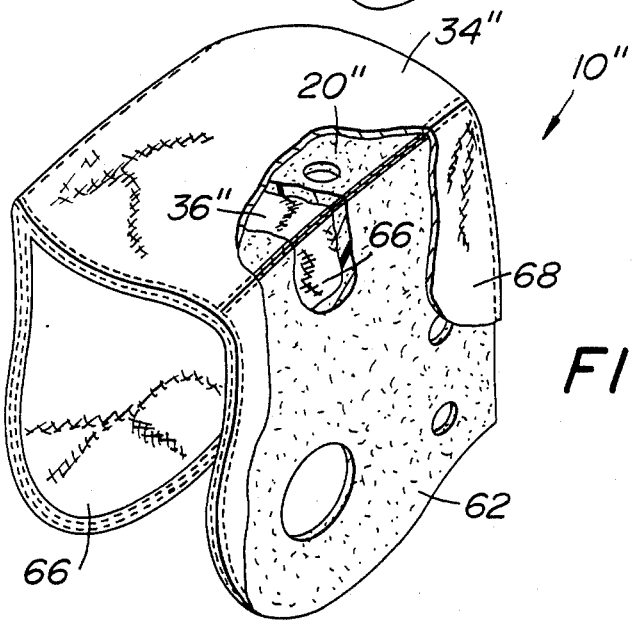
FIG. 8 is a perspective view, partly broken away, showing the embodiment of FIG. 7.

The protective hat 10 in FIG. 1 represents one major variation of the invention, intended for use by girls, and having decorative ruffles 12, which are described in greater detail below. FIG. 7 illustrates an alternative form 10' of protective hat, which has a peak (designated generally by the reference numeral 14) rather than the ruffles 12, and which is more suitable for use by boys. FIGS. 8 and 9 show another form of hat, suitable for use by boys or girls.

The protective hats 10 and 10' comprise a head-enveloping member, designated generally by the reference numeral 16, which in the illustrated embodiment may also be referred to as a "crown." The head-enveloping member 16 is adapted to overlie and protect at least the sides and one other area of the head of a wearer. In the embodiments of the invention illustrated in FIGS. 1 and 7 (and elsewhere in the drawings), the head-enveloping number 16 overlies the sides and top of the head of the water.

The head-enveloping member 16 is an arcuate member, generally U-shaped in cross-section. In conjunction with a closure member 18, which is affixed to it in a manner described below, it forms a concavity, closed on three sides and at the top, which may be placed over the head of the wearer. The closure 18 in the illustrated form of the inventions, is a separate piece, and it is so arranged with respect to the head-enveloping member 16 that edge portions of the closure member 18 are complemental with and coupled to respective edge portions of the head-enveloping member 16. The head-enveloping member 16 and closure member 18 of the protective hat 10 are each made up of a resilient shock absorbent core of plastic polymeric material, enclosed by a shell of textile fabric material, as is perhaps best seen in FIG. 4.

Figure 2:
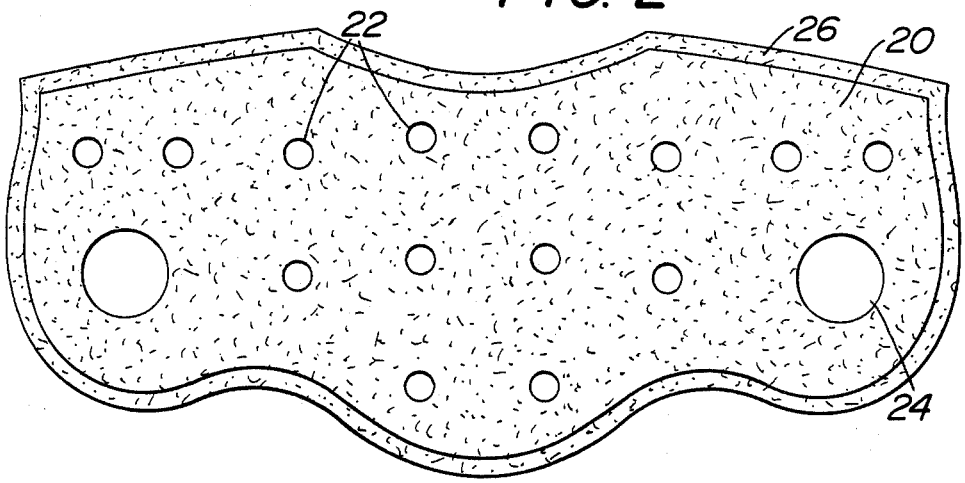
FIG. 2 is a plan view of a core element used in the present invention.

FIG. 2 illustrates a presently preferred form a core 20 for the head-enveloping member or crown 16. The core 20 comprises a flat sheet of shock absorbent and thermally insulating material, which may be cut or die stamped to shape from a flat sheet of raw material. The core 20 may be perforated, as by holes 22, to enhance the vapor permeability of the finished hat 10, and may also be perforated, as by the holes 24, at positions that correspond to the ears of the wearer. The edges 26 of the core 20 are bevelled, for a purpose described below, and the shape of the core 20 is such as to facilitate assembly of the head-enveloping member 16 and closure member 18 to provide the desired configuration of the protective hat 10.

Figure 3:
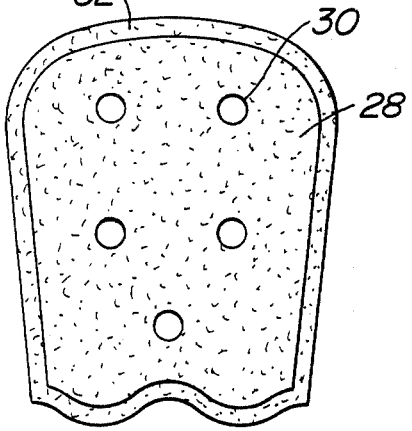
FIG. 3 is a plan view of another core element used in the present invention.

Similarly, referring to FIG. 3, the core 28 of the closure member 18 may be cut or die stamped from a sheet of suitable material, preferably the same kind of material as the core 20. Like the core 20, the core 28 may be provided with holes 30, which serve the same purpose as the above-mentioned holes 24. The edges 32 of the core 28 may be bevelled, as at 32, complementally with the bevelled edge 26 of the core 20.

The core 20 is enclosed by fabric shell pieces 34 and 36, stitched together around their peripheries and outside the periphery of the core 20. The core 28 is preferably enclosed by similar material. Thus, referring again to FIG. 4, an outer shell piece 38 and inner shell piece 40 are associated with the core 28. Like the above-described outer and inner shell pieces 34 and 36, the shapes of the respective shell pieces 38 and 40 approximate the shape of the core with which they are associated, the core 28, and the outer shell piece 38 and inner shell piece 40 are stitched together around their periphery and outside the periphery of the core 28.

The material from which the shell pieces 34, 36, 38 and 40 are made may be any suitable fabric. In one presently preferred form of the invention, the material used for the shell pieces is a broadcloth of 65% polyester and 35% cotton. Such a material provides a desirable degree of durability and soil resistance, as well as an acceptable feel and conventional appearance. It has been found desirable to cut the inner shell pieces 36 and 40 on the bias, whereas the outer shell pieces 34 and 36 are straight of grain.

Figure 5:
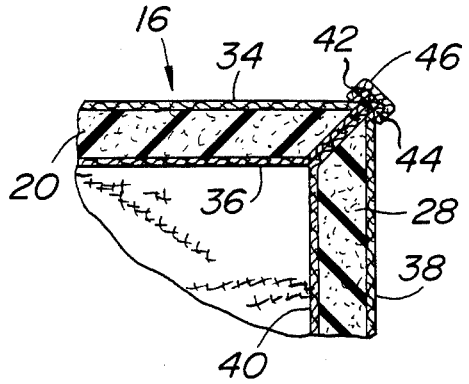
FIG. 5 is a partial cross-sectional view, taken along the line 5—5 in FIG. 1, and showing a construction detail of a protective hat in accordance with the invention.

FIG. 5 shows a construction detail of a protective hat 10 in accordance with the invention. It illustrates the relationship between the cores 20 and 28 and the shell pieces 34 and 36 and 38 and 40, respectively, associated with them. It also illustrates the manner in which the head-enveloping member 16 and closure member 18 may be assembled. Referring to FIG. 5, it will be the outer piece 34 and inner shell peice 36 and the outer shell piece 38 and the inner shell piece 40, when sewn together, provide a small area of selvage which facilitate their being stitched together around the edges of the head-enveloping member 16 and closure member 18. The bevelled edges 26 and 32 of the cores 20 and 28 provide in effect, a "mitre" or right-angle corner.

The cores 20 and 28 are ideally made from dimensionally stable, chemically inert, highly impact resistant material. One suitable material, which is presently preferred is sold by Uniroyal, Inc. under the trademark "Ensolite", type "AA." It comprises a closed-cell foam of specially modified PVC with nitrile rubber. The material is a cross-linked polymer capable of withstanding repeated impact/recovery cycles, and has a density of between about 4.0 and 6.0 lbs./cu. ft., a thermal conductivity of 0.26, and a 25% compression resistance of 5.0 to 7.0 psi. at 70° F. In presently preferred forms of the invention, the cores 20 and 28 have thicknesses of about $\frac{1}{4}$ to $\frac{3}{8}$ inches.

Figure 4:
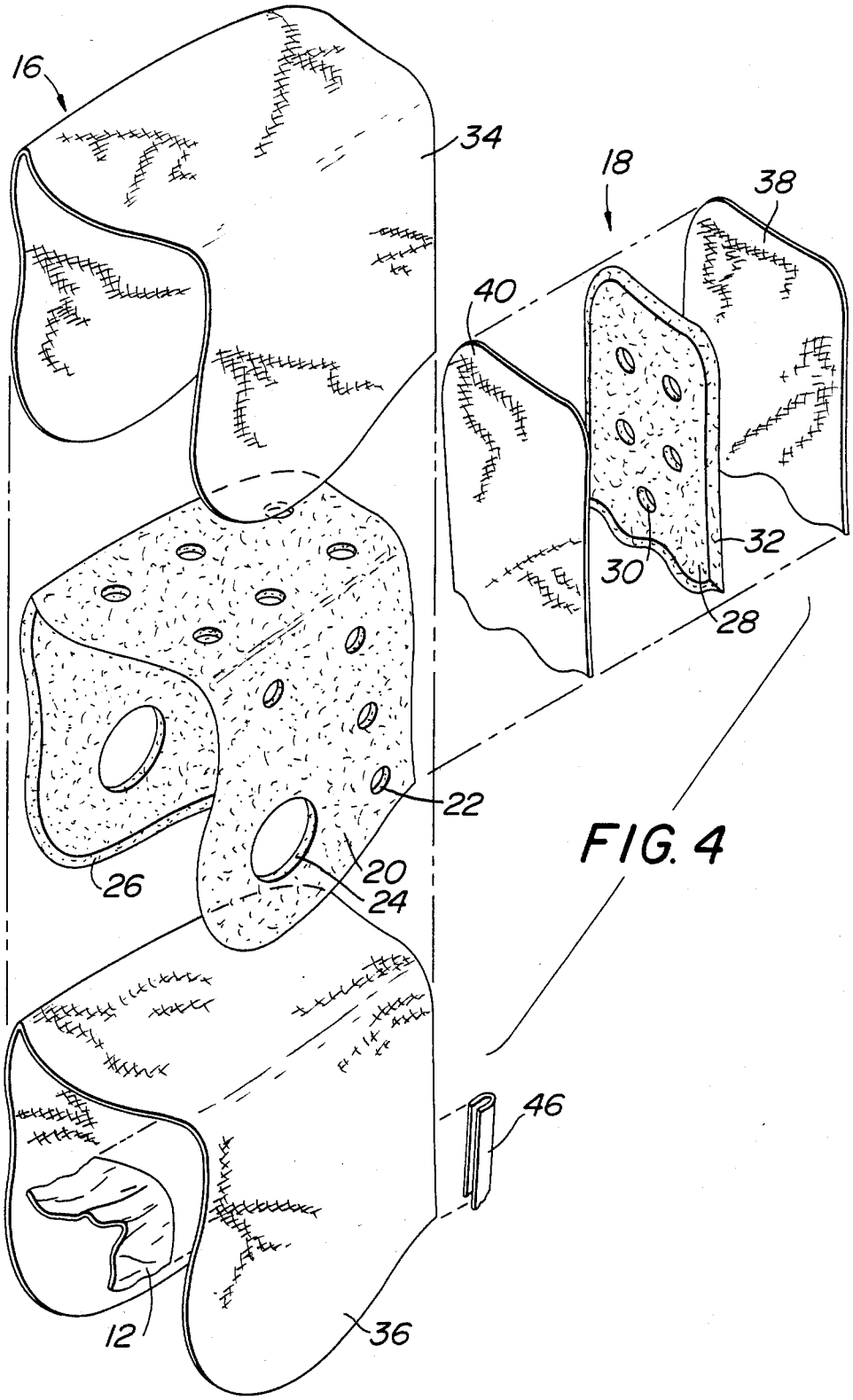
FIG. 4 is an exploded view, showing details of the construction of a protective hat in accordance with the invention.

Referring now to FIG. 4, the shell of textile fabric material which encloses the cores 20 and 28 will now be described. Referring to the head-enveloping member 16, the shell is made up of an outer shell piece 34, which provides the outer surface of the top and sides of the protective hat 10, and an inner shell piece 36, which provides the inner lining of the side and top portions of the protective hat 10. The outer and inner shell pieces 34 and 36 are cut or stamped to a shape somewhat similar to the shape of the core 20, but somewhat larger, and they are stitched to each other around their peripheries outside the peripheral edge of the core 20. When such stitching is completed, the outer and inner shell pieces 34 and 36 fully enclose and encapsulate the core 20, so that the outer surfaces of the protective bonnet 10 have a conventional appearance and texture imparted by the textile fabric material of the outer and innter shell pieces 34 and 36.

As in the case of the core 20, the core 28 is also enclosed and encapsulated in a shell of textile fabric, joined between the plane defined by the closure member 18 and the side and top walls of the hat is provided by the head-enveloping member 16. A variety of stitching and finishing techniques may occur to those skilled in the art, but is is presently preferred that the selvage of the outer shell piece 34 and 36 and the selvage of the outer shell piece 38 and inner shell piece 40 be joined by a line of stitching 44, and that bias tape 46 be used to "pipe" or finish the edge.

Figure 6:
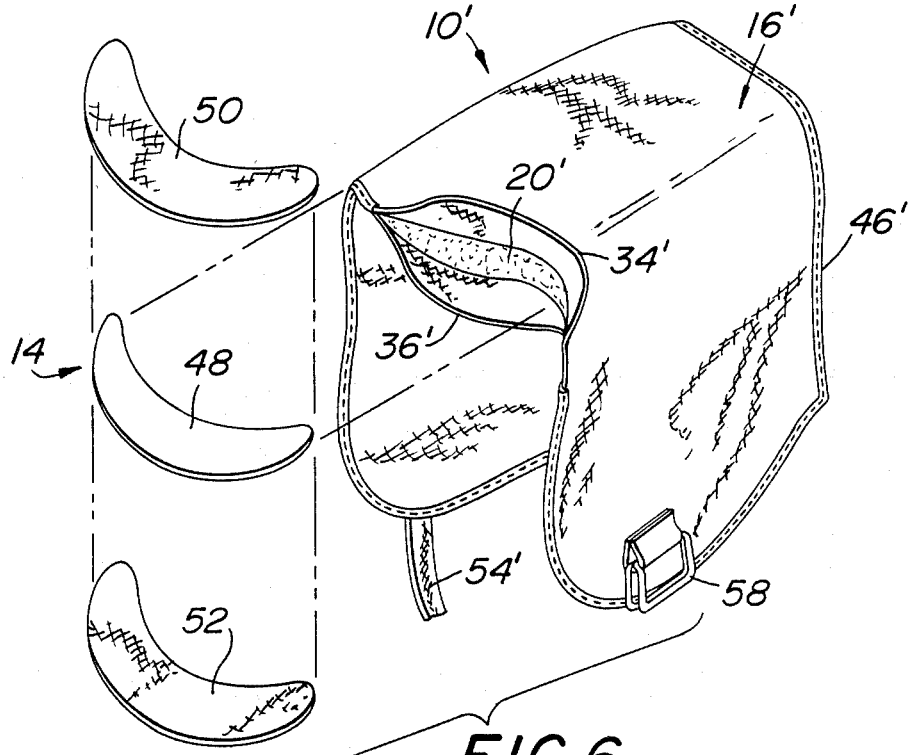
FIG. 6 is a perspective view, partly exploded and broken away, showing a variation of the invention.

Referring now to FIG. 1, the botom and front edges of the embodiment of the protective hat 10 shown in that Figure are provided with the above-mentioned ruffle 12. Referring, however, to FIG. 6, (wherein elements corresponding to those previously described are designated by like primed(') reference numerals) the protective hat 10' may be provided with a peak 14 in the following manner. In the protective hat 10', a core 48, cut approximately to the desired shape of the peak 14, is encased within a pair of fabric shell pieces 50 and 52, and the assembly thus created is sewn into the seam between the outer shell piece 34' and inner shell piece 36' at the front of the protective hat 10'. As before, bias tape 46' may be used to finish the edges around the peripheries of the head-enveloping member 16' and the closure member (not seen).

In either embodiment, suitable ties 54, 54' may be used to secure the protective hat 10, 10' to the head of the user.

For example, referring to FIG. 1, in the protective hat 10, intended for use by girls, the tie 54 may be provided with a bow 56 at this point of anchorage with the head-enveloping member 16, and the tie itself may be of the type which is intended to be tied into a bow. On the other hand, referring to FIG. 6, the embodiment 10', intended to be used by boys, is provided with a tie 54' which has a buckle 58. Such a tie could of course be used in conjunction with the embodiment 10 if so desired.

Referring now to FIGS. 7 and 8, there is seen an embodiment 10'' of a protective hat in which elements corresponding to those previously described are designated by like double-primed (") reference numerals.

In the protective hat 10'', the core 20'' is an arcuate member which covers, in general, the head of the wearer from the top of the forehead to the nape of the neck. The remainder of the head-enveloping member 16'' is built around side core pieces 60 and 62, which have bevelled edges 64 which complement bevelled edges 26″ of the core 20″. Fabric shell pieces 34″, 36″, 66 and 68 encapsulate the core 20″ and side core pieces 60 and 62.

The hat 10″ provides a simplified construction, suitable by reason of its shape and lack of trim, for use by boys and girls.

Suitable ties, not shown, may be used with the hat 10″.

The present invention may be embodied in other specific forms without departing from its spirit or essential attributes. Accordingly, reference should be made to the appended claims rather than the foregoing specification and accompanying drawings for an indication of the scope of the invention.

I claim:

1. A protective hat having shock absorptive and insulating properties, comprising a head-receiving member adapted to overlie and protect at least the sides, top and rear of the head of a wearer, said head-receiving member comprising a core of resilient shock absorbent polymeric foam material and a shell of textile fabric material, said shell being so constructed and arranged as to fully enclose and encapsulate said core so that said hat has a conventional appearance and surface texture, said heat-receiving member comprising an arcuate member adapted to partly encircle the head of a wearer, and at least one closure member, said closure member having edge portions thereof complemental with and fixedly coupled to respective edge portions of said arcuate member so that said arcuate and said closure member define a concavity adapted to receive the head of a wearer, and said core comprising closed cell foam material consisting of a cross-linked polymer of modified PVC and nitrile rubber having a thickness of about $\frac{1}{4}$ to about $\frac{3}{8}$ inches.

2. Apparatus in accordance with claim 1 wherein said arcuate member is a generally U-shaped member, so configured and arranged as to cover the sides and top of the head of a wearer, and said closure member is so configured and arranged as to cover the rear of the head of a wearer.

3. Apparatus in accordance with claim 1, wherein said arcuate member is so configured and arranged as to cover the top and rear of the head of a wearer, and a pair of closure member cover the sides of the head of a wearer.

4. A protective hat having shock absorptive and insulating properties, comprising a head-receiving member adapted to overlie and protect at least the sides, top and rear of the head of a wearer, said head-receiving member comprising a core of resilient shock absorbent polymeric foam material and a shell of textile fabric material, said shell being so constructed and arranged as to fully enclose and encapsulate said core so that said hat has a conventional appearance and surface texture; said head-receiving member comprising an arcuate member adapted to partly encircle the head of a wearer, and at least one closure member, said closure member having edge portions thereof complemental with and coupled to respective edge portions of said arcuate member so that said arcuate and said closure member define a concavity adapted to receive the head of a wearer; and said arcuate member and said closure member having individual core pieces therein; said shell comprising respective fabric pieces juxtaposed to inner and outer faces of said core pieces; said fabric pieces of said arcuate member being stitched together around their periphery and outside the periphery of said core piece of said arcuate member; said fabric pieces of said closure member being stitched together around their periphery and outside the periphery of said core piece of said closure member; and said fabric pieces of said arcuate member and said closure member, respectively, being sewn together to couple together the edge portions of said members.

5. Apparatus in accordance with claim 4, wherein said core pieces have bevelled edges, said bevelled edges facilitating coupling of the edge portions of said arcuate member and said closure member.

6. Apparatus in accordance with claim 1, wherein said fabric pieces juxtaposed to the inner faces of said core pieces are oriented on the bias.

7. Apparatus in accordance with claim 5, wherein said arcuate member is a generally U-shaped member, so configured as to cover the sides and top of the head of a wearer when the hat is operatively disposed, said closure member adapted to cover the back of the head when the hat is operatively disposed, said bevelled edges being disposed on a rear edge of the core of said generally U-shaped member and on the upper and side edges of the core of said closure member.

8. Apparatus in accordance with claim 5, and a tie member coupled to said arcuate member for affixing the hat to the head of a wearer.

* * * * *